US005396907A

United States Patent [19]

Rojas Henao et al.

[11] Patent Number: 5,396,907

[45] Date of Patent: Mar. 14, 1995

[54] DEVICE FOR CONTAINING SECONDARY SMOKE

[76] Inventors: Jerry Rojas Henao, 218 N. Conejo Ave., Modesto, Calif. 95354; Ivan Rojas, 329 Colorado Ave.; Roger Rojas, 725 Paradise Rd., both of Modesto, Calif. 95351

[21] Appl. No.: 94,538

[22] Filed: Jul. 20, 1993

[51] Int. Cl.[6] ..... A24F 13/02

[52] U.S. Cl. ..... 131/175; 131/185; 131/187

[58] Field of Search ..... 131/175, 185, 187, 329, 131/330, 270

[56] References Cited

U.S. PATENT DOCUMENTS

| | | | |
|---|---|---|---|
| 2,108,218 | 2/1938 | Stultz | 131/175 |
| 2,761,456 | 9/1956 | Pirrone | 131/185 X |
| 3,709,233 | 1/1973 | Stelitano | 131/185 X |
| 4,148,328 | 4/1979 | Fox | 131/187 X |
| 4,621,649 | 11/1986 | Osterrath | 131/185 |
| 4,774,970 | 10/1988 | Bell | 131/185 X |
| 4,790,332 | 12/1988 | Wallace | 131/187 X |
| 4,899,766 | 2/1990 | Ross, Jr. | 131/175 |
| 4,993,435 | 2/1991 | McCann | 131/175 X |
| 5,048,545 | 9/1991 | Takagi et al. | 131/175 X |

*Primary Examiner*—Jennifer Bahr
*Attorney, Agent, or Firm*—Skjerven, Morrill, MacPherson, Franklin & Friel; David E. Steuber

[57] ABSTRACT

A device including a housing, a mouthpiece, a bellows, and an igniter is provided to contain secondary smoke. A cigarette may be sealed in the housing of the device and lit by the igniter. Once the cigarette is lit, when a smoker draws a breath through the mouthpiece, air is drawn through the lit cigarette and the resulting smoke-ladened air from the cigarette passes into the smoker's mouth. If the smoker then exhales into the device, the exhaled smoke is conducted to the bellows. The secondary smoke, thus trapped in the bellows, may later be released where it is safe and permissible to do so.

22 Claims, 4 Drawing Sheets

DEVICE FOR CONTAINING SECONDARY SMOKE

BACKGROUND OF THE INVENTION

Secondary smoke has been linked to a broad range of maladies, from life-threatening diseases such as cancer, emphysema, and heart disease, to less severe ailments, such as sore throats and colds.

In response to these well-documented health threats, new laws have been enacted nationwide to protect non-smokers from the harmful effects of secondary cigarette smoke. These laws offer non-smokers some protection, but also infringe on the smoker's right to smoke. Moreover, despite the new laws, many people continue to be subjected to secondary smoke, both with and without their consent. Of particular concern, for example, are children who share a home with one or more smokers.

In addition to adversely effecting the health of non-smokers, secondary smoke contaminates exposed articles, such as furniture, clothes, car upholstery, and air conditioners. Such contamination may impart offensive odors and otherwise damage the effected articles.

Various types of filters and ionizing air cleaners are currently available on the market. However, they are often expensive and, because the smoke must first be expelled into the atmosphere before it can be treated, do not fully protect non-smokers and exposed articles from secondary smoke.

The dangers of smoking cigarettes are not limited to those associated with the inhalation of cigarette smoke. Many lives are lost, and an extraordinary amount of property is damaged, as a result of fires caused by the careless disposal of lit cigarettes. Additionally, smokers and non-smokers alike fall victim to fires that occur when smokers fall asleep while smoking. Those not directly affected by these needless tragedies share the burden of the resulting loss of lives and property in the form of increased insurance costs.

For the foregoing reasons, there is a need for an inexpensive, portable device that will contain secondary smoke, thereby permitting smokers to indulge in their habit without infringing on the right of non-smokers to breathe clean air. Moreover, there is a need for a device that isolates a burning cigarette from the surrounding environment, thereby decreasing the incidence of fires caused by the careless disposal of cigarettes.

SUMMARY

The present invention is directed to a device that satisfies both the need to contain secondary smoke and the need to isolate burning cigarettes from the surrounding environment. A device for containing secondary smoke having features of the present invention comprises a heat-resistant housing having a chamber in which to place a cigarette. Inside the cigarette chamber there is located an electric igniter for igniting one end of the cigarette, the igniter being powered by a power source adjacent the cigarette chamber. Attached to the housing is a mouthpiece for drawing smoke from the cigarette chamber into a smoker's mouth, and for receiving smoke exhaled from the smoker's mouth back into the housing. Exhaled smoke travels through the housing and into a bellows where the smoke is trapped.

To smoke a cigarette while containing the secondary smoke, a cigarette is enclosed in the cigarette chamber with the igniter adjusted to contact an end of the cigarette. The cigarette may be lit by momentarily applying power to the igniter while drawing a breath through the mouthpiece to provide fresh air to the cigarette chamber.

If the smoker continues to inhale through the mouthpiece after the cigarette is lit, fresh air will be drawn into the chamber and through the lit cigarette. Smoke from the lit cigarette then passes through the mouthpiece and into the smoker's mouth. If the smoker then exhales into the mouthpiece, the exhaled smoke will pass through the housing and into the bellows. The secondary smoke, thus contained within the bellows, may later be expelled where it is safe and permissible to do so.

In a second embodiment of the present invention, a detachable filter unit is used in place of the bellows. In this configuration, secondary smoke is filtered instead of stored for later disposal. The filter unit comprises a heat-resistant filter material capable of filtering out smoke and odors. The filter material may be disposable or washable.

Either of the two aforementioned embodiments allow smokers to indulge in their habit without infringing on the rights of non-smokers to breathe clean air. Moreover, because the cigarette is fully contained within the housing of the device, the risk of fire is greatly reduced.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
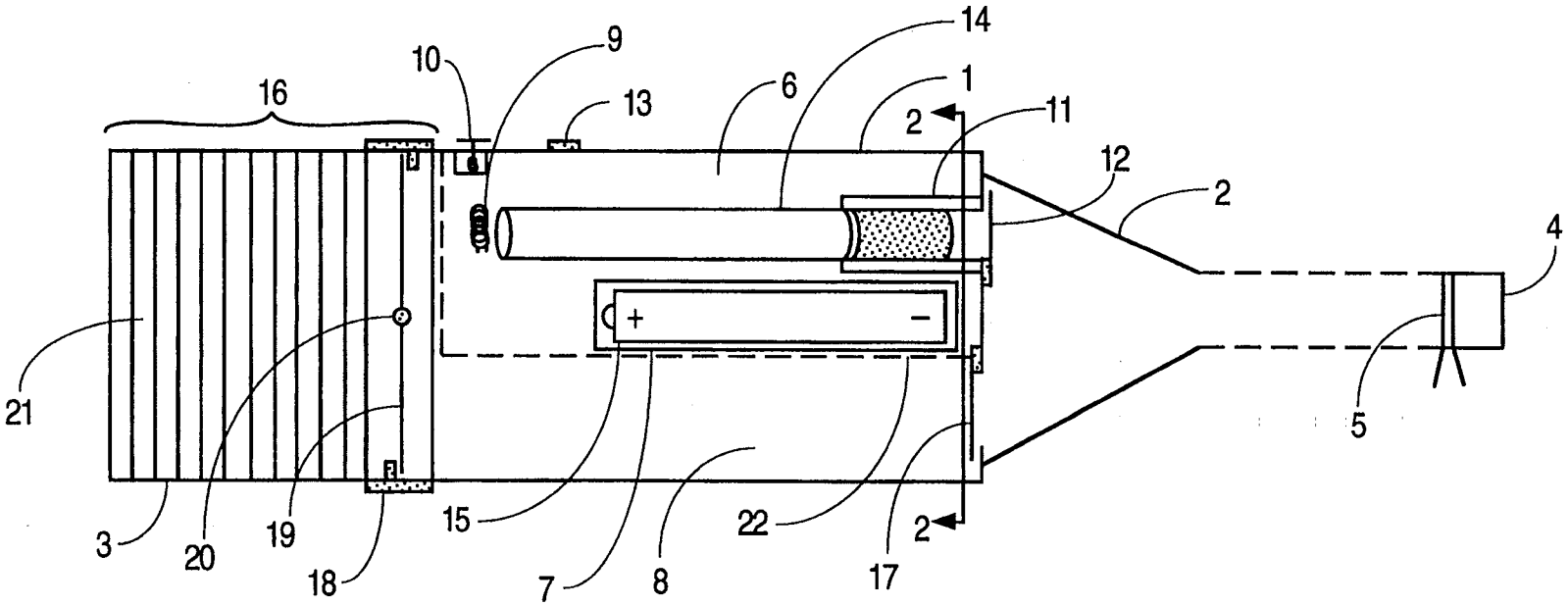
FIG. 1 is a cross-sectional view taken along the length of a device embodying features of the present invention for containing secondary smoke.

As shown in FIG. 1, a device for containing secondary smoke comprises a housing 1, an inlet/outlet tube 2, and a bellows 3 removably attached to the housing 1.

The inlet/outlet tube 2 may be made of any durable, non-toxic, fire- and heat-resistant material, and includes a replaceable mouthpiece 4 and a mouthpiece shut-off valve 5.

The housing 1 comprises a cigarette chamber 6, a battery holder 7, and an exhaust conduit 8. The housing 1 may be made of any non-toxic, durable, fire- and heat-resistant material.

The cigarette chamber 6 is open to the bellows 3, and has at one end an igniter 9 and a spring-loaded, manually-operable, fresh-air intake valve 10. At its other end, the cigarette chamber 6 has a cigarette holder 11 and a one-way intake valve 12. The igniter 9 includes a resistive heating element, and is electrically connected to the battery holder 7 and the momentary contact igniter switch 13. The igniter 9 is mounted on a sliding mechanism (not shown) so that it can be adjusted to contact one end of a cigarette 14. The cigarette holder 11 secures the cigarette 14, and fully surrounds the unlit end of the cigarette 14. The one-way intake valve 12 is configured to allow smoke to flow from the cigarette chamber 6 to the inlet/outlet tube 2, and to prevent flow from inlet/outlet tube 2 to the cigarette chamber 6.

The battery holder 7 provides support and electrical contacts for a battery 15. The battery 15 is used as the power source for the igniter 9.

The exhaust conduit 8 adjoins the bellows 3 at one end. At its other end, the exhaust conduit 8 has a one-way outlet valve 17. The one-way outlet valve 17 allows the contents of inlet/outlet tube 2 to pass to the exhaust conduit 8, but prevents the contents of the exhaust conduit 8 from passing to the inlet/outlet tube 2. The exhaust conduit 8 is open to the cigarette chamber 6 so that smoke may move freely between exhaust conduit 8 and cigarette chamber 6.

The bellows 3 may be made of any durable, fire- and heat-resistant material, and includes a coupling collar 18, a butterfly valve 19, an interlock lever 20, and a bellows chamber 21. The coupling collar 18 is a screw-type collar demountably connected to the housing 1, and provides an air-tight seal when coupled to the housing 1. The butterfly valve 19 is positioned between the bellows chamber 21 and the exhaust conduit 8, and may be positioned to seal the contents of the bellows chamber 21, or to allow flow between the housing 1 and the bellows chamber 21. The position of the butterfly valve 19 is controlled by interlock lever 20, as is illustrated by FIGS. 4 and 5.

Figure 3:
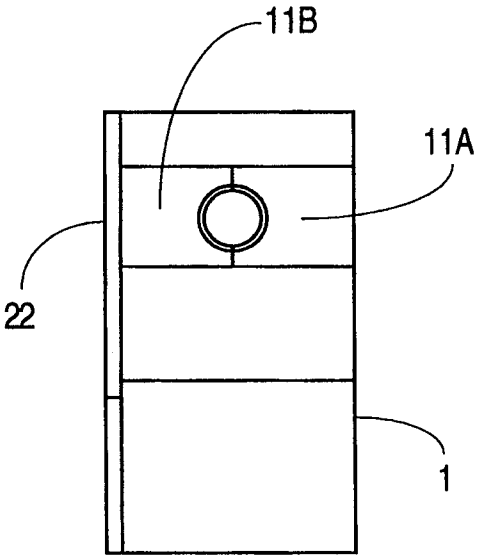
FIG. 3 shows a cross-sectional view of the device of FIG. 1, at section A—A of FIG. 1, with the access door to the cigarette chamber closed.
Figure 2:
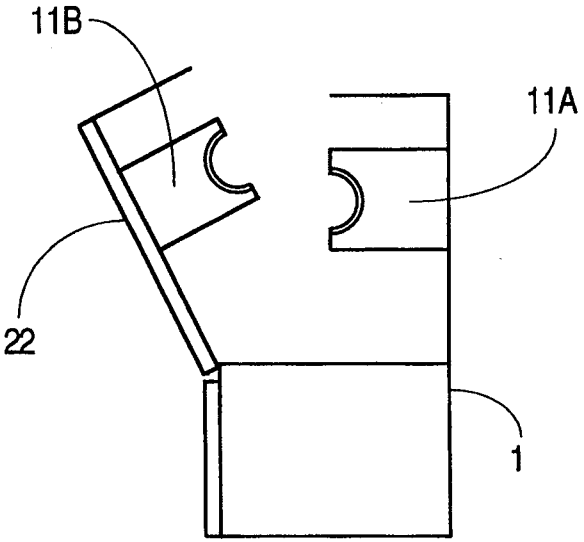
FIG. 2 shows a cross-sectional view of the device of FIG. 1, at section A—A of FIG. 1, with the access door to the cigarette chamber open.

FIGS. 2 and 3 show cross-sectional views of the housing 1 at section A—A of FIG. 1. An access door 22 is provided to access the cigarette chamber 6 and the battery holder 7. FIG. 2 shows the housing 1 with the access door 22 open; FIG. 3 shows the housing 1 with the access door 22 closed. The cigarette holder 11 includes opposed semi-cylindrical members 11A and 11B, that converge to form a cylindrical recess that supports one end of the cigarette 14 when the access door 22 is closed.

Figure 5:
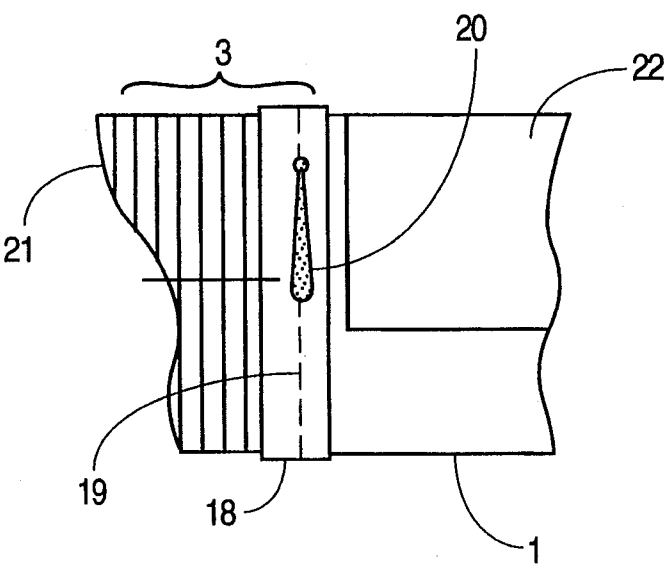
FIG. 5 is a side view of a device embodying features of the present invention for containing secondary smoke, wherein the interlock lever is in the closed position.
Figure 4:
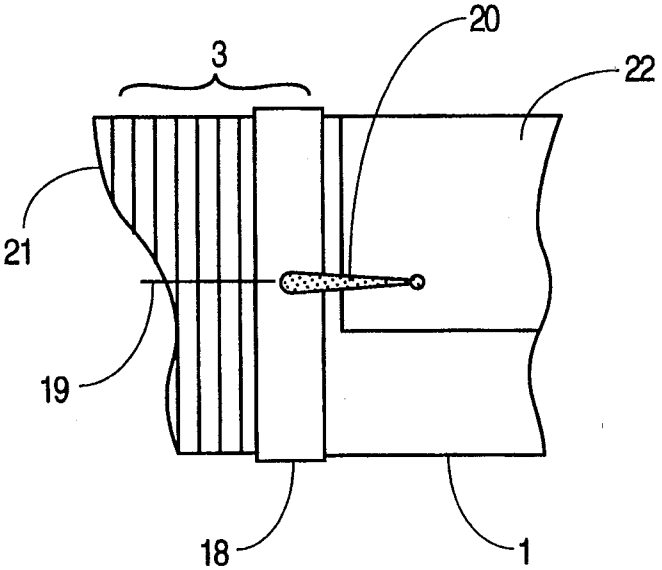
FIG. 4 is a side view of a device embodying features of the present invention for containing secondary smoke wherein the interlock lever is in the open position.

FIGS. 4 and 5 illustrate the operation of the interlock lever 20. When the interlock lever 20 is normal to the plane described by the coupling collar 18, as shown in FIG. 4, the butterfly valve 19 is open and the interlock lever 20 engages the access door 22 so that the access door 22 may not be opened. In addition, with the interlock lever 20 thus positioned, the coupling collar 18 may not be turned, and the bellows 3 may therefore not be removed. As shown in FIG. 5, when the interlock lever 20 is parallel to the plane described by the coupling collar 18, the butterfly valve 19 seals the bellows chamber 21, the access door 22 is unlocked, and the bellows 3 may be removed from the housing.

To smoke a cigarette while containing the secondary smoke, the smoker first attaches the bellows 3 to the housing 1 and places the interlock lever 20 in the position shown in FIG. 5. With the interlock lever 20 thus positioned, the butterfly valve 19 is closed and the access door 22 may be opened. The smoker then opens the access door 22 and places a cigarette 14 into the cigarette chamber 6. The smoker also may place a battery 15 in the battery holder 7 if no battery 15 is in place or if the battery 15 in place is dead. The smoker then brings the igniter 9 into contact with the end of the cigarette 14 and closes the access door 22, thus securing the cigarette 14 between semi-cylindrical members 11A and 11B of the cigarette holder 11 and sealing the cigarette chamber 6. Next, the smoker places the interlock lever 20 in the position shown in FIG. 4. With the interlock lever 20 thus positioned, the butterfly valve 19 is open and the access door 22 is locked shut.

If, after opening the mouthpiece shut-off valve 5 and the fresh-air intake valve 10, the smoker draws a breath through the replaceable mouthpiece 4, fresh air will enter the cigarette chamber 6 through fresh-air intake valve 10. The cigarette 14 may be lit by pressing the momentary contact igniter switch 13 while drawing a breath through the replaceable mouthpiece 4. The momentary contact igniter switch 13 sends power from the battery 15 to the igniter 9. The resistive heating element of igniter 9 is thus heated to ignite the cigarette 14.

Once the cigarette 14 is lit, if the smoker draws a breath through the replaceable mouthpiece 4, smoke from the lit end of the cigarette 14 will pass through the cigarette 14 and the one-way intake valve 12 to the inlet/outlet tube 2. Once inside the inlet/outlet tube 2, the smoke will continue through the mouthpiece shut-off valve 5 and into the smoker's mouth. The one-way outlet valve 17 will not allow the smoker to directly inhale the contents of the conduit 8.

If the smoker them exhales into the replaceable mouthpiece 4, the exhaled smoke will pass through the mouthpiece shut-off valve 5 and into the inlet/outlet tube 2. The exhaled smoke is blocked from passing back through the cigarette 14 by the one-way intake valve 12, and passes into the exhaust conduit 8 via the one-way outlet valve 17. The exhaled smoke then passes from the exhaust conduit 8 through the open butterfly valve 19 and into the bellows chamber 21, which expands to accommodate the exhaled smoke. When finished exhaling, the smoker closes the mouthpiece shut-off valve 5, thereby containing any smoke lingering in the inlet/outlet tube 2.

While the cigarette 14 remains lit, the smoker may continue to inhale and exhale smoke through the mouthpiece 4 as described above, thereby containing the secondary smoke. The fresh-air intake valve 10 need not be opened each time the smoker draws a breath through the replaceable mouthpiece 4. If the fresh-air intake valve 10 is not opened, the smoker will draw smoke-ladened air from the bellows chamber 21 through the cigarette 14. The smoke-ladened air normally contains enough oxygen to keep the cigarette 14 lit, and recycling air allows the smoker to smoke longer before filling the bellows chamber 21 to capacity.

Because the cigarette chamber 6 is open to the bellows chamber 21 and the exhaust conduit 8, the cigarette 14 will remain lit as long as there is sufficient oxygen in the smoke contained in the housing 1 and the bellows 3 to support combustion in the cigarette 14. If the cigarette 14 goes out, it may be re-ignited by adjusting the igniter 9 to contact one end of the cigarette 14, opening the fresh-air intake valve 10, and pressing the momentary contact igniter switch 13 while drawing a breath through the replaceable mouthpiece 4.

When the smoker is finished smoking the cigarette, the smoker purges the housing 1 of lingering smoke by expanding the bellows chamber 21 while holding open the mouthpiece shut-off valve 5. The smoker then moves the interlock lever 20 to the position shown in FIG. 5, thereby closing butterfly valve 19 and sealing the bellows chamber 21. With the secondary smoke thus contained, the smoker may detach the bellows 3.

With the secondary smoke thus contained in a detached bellows 3, the smoker may open the butterfly valve 19 and expel the secondary smoke where it is safe and permissible to do so. Of course, the smoker may make use of any number of detachable bellows units to contain secondary smoke until the smoke may be conveniently discarded.

Figure 6:
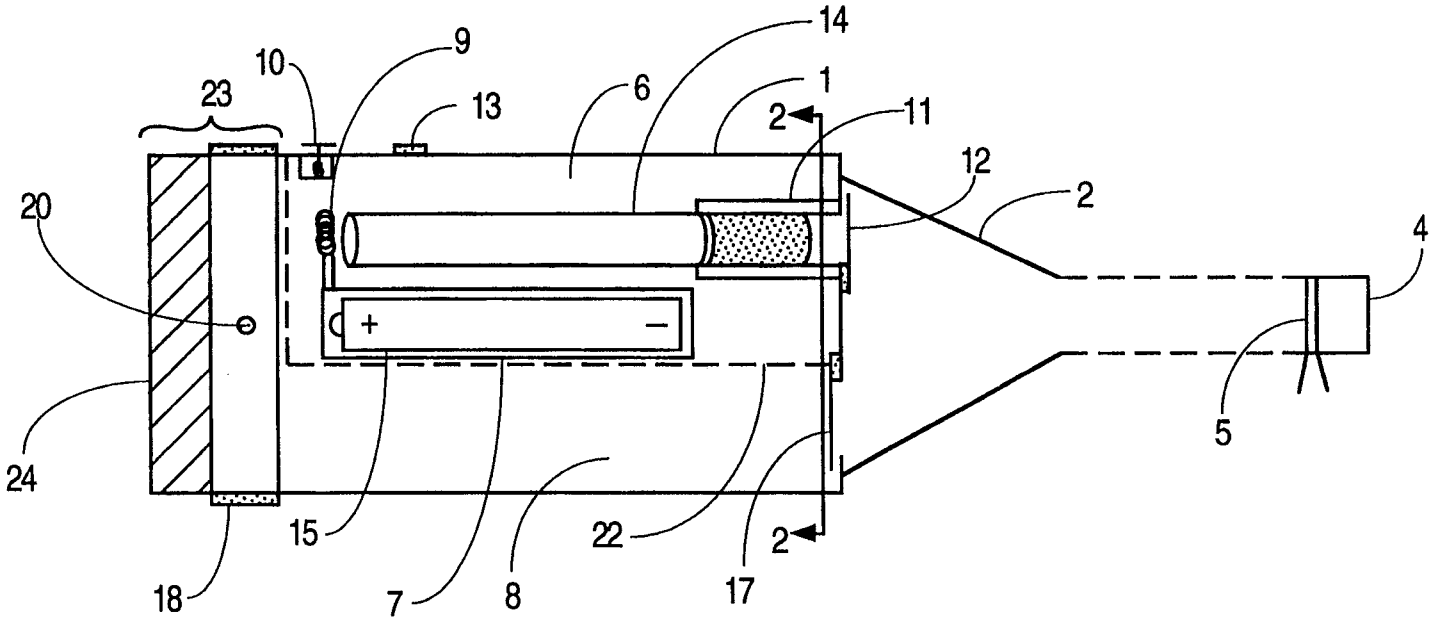
FIG. 6 is a cross-sectional view taken along the length of a second embodiment of the present invention for containing secondary smoke.

FIG. 6 shows another embodiment of the present invention wherein a detachable filter unit 23 is used in place of the bellows 3. This configuration functions in substantially the same way as the aforementioned embodiment of FIGS. 1–5, except that secondary smoke is filtered instead of stored for later disposal. The filter unit 23 comprises a non-toxic, heat-resistant filter 24 capable of filtering out smoke and odors. The filter 24 may be disposable or washable.

Although the present invention has been described in considerable detail with reference to certain preferred versions thereof, other versions are possible. For example, the invention may adapted for use with cigars and pipe tobacco, or installed in a car so that the smoker inhales and exhales through a tube, and the secondary smoke is expelled outside the vehicle. Furthermore, the mouthpiece and the bellows or filter need not be detachable. Therefore, the spirit and scope of the appended claims should not be limited to the description of the preferred versions contained herein.

We claim:

1. A device for containing smoke from a tobacco sample, as said tobacco sample is smoked by a smoker, so as to isolate said smoke from a surrounding environment, said device comprising:

a housing;

a tobacco chamber in said housing;

a fresh-air intake valve between said environment and said tobacco chamber, said intake valve for providing fresh air to said tobacco sample and preventing smoke from escaping into said environment;

an inlet/outlet tube extending from said tobacco chamber, said inlet/outlet tube for allowing smoke to pass from said tobacco chamber to a mouthpiece;

an expandable smoke container;

a first flow path extending from said inlet/outlet tube to said expandable smoke container, a first valve being interposed in said first flow path to prevent smoke in said smoke container from flowing through said mouthpiece; and a second flow path extending from said tobacco chamber to said expandable smoke container, a second valve being interposed in said second flow path, said second valve being opened when a lit tobacco sample is within said tobacco chamber so as to allow air from said smoke container to enter said tobacco chamber and thereby provide oxygen to the tobacco sample.

2. The device of claim 1 wherein said inlet/outlet tube comprises a third valve which, when closed, prevents air in said inlet/outlet tube from flowing through said mouthpiece.

3. The device of claim 1 further comprising a means for igniting said tobacco sample.

4. The device of claim 3, wherein said igniting means comprises:

an igniter;

means for bringing said igniter into contact with said tobacco sample;

a power source; and means for selectively providing power from said power source to said igniter.

5. The device of claim 1 wherein said smoke container comprises a bellows, said bellows being detachably attached to said housing.

6. The device of claim 5 wherein said second valve comprises a butterfly valve.

7. The device of claim 6 further comprising an access door to said tobacco chamber and an interlock mechanism, said interlock mechanism when in a first position simultaneously preventing said access door from being opened and locking said bellows to said housing.

8. The device of claim 7 wherein said interlock mechanism in a second position closes said second valve.

9. The device of claim 1 further comprising a third valve for allowing smoke to pass from said tobacco chamber into said inlet/outlet tube and preventing said smoke from passing from said inlet/outlet tube to said tobacco chamber.

10. The device of claim 1 wherein said tobacco sample comprises a cigarette.

11. A device for containing smoke from a tobacco sample, as said tobacco sample is smoked by a smoker, so as to isolate said smoke from a surrounding environment, said device comprising:

a housing;

a tobacco chamber in said housing, said tobacco chamber comprising an access door;

a tobacco sample holder in said chamber for providing support for said tobacco sample;

a heat source located entirely within said chamber for igniting said tobacco sample;

a power source for providing power to said heat source;

a switch for connecting said power source to said heat source, said switch being controlled from outside said tobacco chamber so as to permit said igniter to ignite said tobacco sample while said access door is closed;

a fresh-air intake valve between said environment and said chamber, said intake valve for providing fresh air to said tobacco sample and preventing smoke from escaping said chamber into said environment;

an inlet/outlet tube connected to said housing, said inlet/outlet tube for conducting smoke to and from said housing;

a conduit in said housing for conducting smoke through said housing; and a smoke chamber for receiving said smoke from said conduit, said smoke container being attached to said housing.

12. The device of claim 11 wherein said inlet/outlet tube comprises a replaceable mouthpiece.

13. The device of claim 11 wherein said inlet/outlet tube comprises a shut-off valve for selectively opening and closing said inlet/outlet tube.

14. The device of claim 11 wherein said smoke container means comprises a detachable bellows.

15. The device of claim 14 wherein said bellows comprises a butterfly valve for sealing the contents of said bellows.

16. The device of claim 15 wherein said bellows further comprises a means for locking said bellows to said housing and barring access to said chamber.

17. A device for isolating a burning cigarette from a surrounding environment as said cigarette is smoked by a smoker, said device comprising:

a housing;

a cigarette chamber in said housing, said chamber for containing said cigarette;

a first opening between said environment and said chamber, said opening for providing fresh air to said cigarette;

a second opening between said chamber and said smoker, said second opening for conducting smoke from said chamber to said smoker; and a means for igniting said cigarette, said means for igniting comprising:

an igniter;

a power source; and a switch for connecting said power source to said igniter while said cigarette chamber is isolated from said surrounding environment so as to prevent smoke from said cigarette from escaping into said surrounding environment.

18. The device of claim 17 further comprising a tube connected to said housing, said tube for conducting said smoke from said chamber to said smoker.

19. The device of claim 18 wherein said tube comprises a replaceable mouthpiece.

20. A device for lighting a cigarette comprising:

a cigarette chamber, said cigarette chamber comprising an access door for introducing a cigarette into said cigarette chamber, an air inlet port which is normally closed but which can be opened to admit air to said cigarette chamber, and a smoke outlet port which is normally closed but which can be opened to allow smoke to be withdrawn from said cigarette chamber;

a heat source positioned entirely within said cigarette chamber; and a means for actuating said heat source from outside said cigarette chamber while said access door is closed, thereby preventing smoke from escaping from said cigarette chamber while said cigarette is being ignited.

21. The device of claim 20 wherein said cigarette chamber further comprises a battery for supplying power to said heat source.

22. The device of claim 21 wherein said heat source comprises a resistive heating element.

* * * * *